US011201424B2

(12) United States Patent
Kliever

(10) Patent No.: US 11,201,424 B2
(45) Date of Patent: Dec. 14, 2021

(54) PRINTED-CIRCUIT BOARD CONNECTOR FOR HIGH-CURRENT TRANSMISSION

(71) Applicant: HARTING ELECTRIC GMBH & CO. KG, Espelkamp (DE)

(72) Inventor: Wilhelm Kliever, Minden (DE)

(73) Assignee: HARTING ELECTRIC GMBH & CO. KG

( * ) Notice: Subject to any disclaimer, the term of this patent is extended or adjusted under 35 U.S.C. 154(b) by 0 days.

(21) Appl. No.: 16/960,848

(22) PCT Filed: Jan. 8, 2019

(86) PCT No.: PCT/DE2019/100009
§ 371 (c)(1),
(2) Date: Jul. 8, 2020

(87) PCT Pub. No.: WO2019/144988
PCT Pub. Date: Aug. 1, 2019

(65) Prior Publication Data

US 2021/0066833 A1 Mar. 4, 2021

(30) Foreign Application Priority Data

Jan. 26, 2018 (DE) ..... 10 2018 101 792.8

(51) Int. Cl.

| | |
|---|---|
| ***H01R 12/72*** | (2011.01) |
| ***H01R 12/52*** | (2011.01) |
| ***H01R 12/58*** | (2011.01) |
| ***H01R 12/70*** | (2011.01) |
| ***H01R 12/73*** | (2011.01) |

(52) U.S. Cl.
CPC ..... *H01R 12/721* (2013.01); *H01R 12/523* (2013.01); *H01R 12/58* (2013.01); *H01R 12/7088* (2013.01); *H01R 12/737* (2013.01)

(58) Field of Classification Search
CPC .... H01R 12/721; H01R 12/523; H01R 12/58; H01R 12/7088; H01R 12/737
USPC ..... 439/626
See application file for complete search history.

(56) References Cited

U.S. PATENT DOCUMENTS 3,917,375 A * 11/1975 Johnson ..... H05K 7/1038 439/487
3,993,383 A * 11/1976 Marino ..... H01R 12/728 439/848
4,037,915 A * 7/1977 Cabaud ..... H01R 12/728 439/858

(Continued)

FOREIGN PATENT DOCUMENTS

DE 202 21 666 1/2006 ..... H01R 12/04
DE 20 2013 010 545 2/2014 ..... H01R 12/58

(Continued)

OTHER PUBLICATIONS

German Search Report issued in German Patent Appln. 10 2018 101 792.8, with English translation, dated Dec. 12, 2018, 15 pages.

(Continued)

*Primary Examiner* — Peter G Leigh
(74) *Attorney, Agent, or Firm* — Hayes Soloway P.C.

(57) ABSTRACT

Disclosed is a connector for forming a high-current connection between two printed circuit boards that are arranged at right angles to one another. For this purpose, a slit pin contact is provided.

5 Claims, 4 Drawing Sheets

(56) References Cited

U.S. PATENT DOCUMENTS 4,226,496 A * 10/1980 Langham ..... H01R 12/721 439/637
4,250,536 A * 2/1981 Barringer ..... H01R 13/68 361/784
4,257,668 A * 3/1981 Ellis, Jr. ..... H01R 4/028 439/59
4,270,829 A * 6/1981 Wilson ..... H01R 12/718 439/83
4,423,920 A * 1/1984 Cooper ..... H05K 3/308 439/62
4,579,406 A * 4/1986 Laursen ..... H05K 1/117 361/777
4,586,764 A * 5/1986 Mullen, III ..... H05K 1/144 439/83
4,598,972 A * 7/1986 Mullen, III ..... H05K 7/1053 439/861
4,752,244 A * 6/1988 Kuhl ..... H05K 3/3405 439/635
4,978,307 A * 12/1990 Billman ..... H01R 12/58 439/83
5,104,324 A * 4/1992 Grabbe ..... H01R 12/83 439/326
5,490,788 A * 2/1996 Mazzochette ..... H01R 12/57 439/83
5,908,333 A * 6/1999 Perino ..... H01R 12/712 439/631
6,151,220 A * 11/2000 Sakamoto ..... H05K 3/325 361/773
6,295,726 B1 * 10/2001 Maatta ..... H01L 23/49811 257/E23.068
6,319,076 B1 * 11/2001 Gollhofer ..... H01R 13/111 439/862
6,508,664 B2 * 1/2003 Phalen ..... H01R 13/112 439/502
6,804,120 B2 * 10/2004 Clark ..... H05K 3/366 361/736
6,805,595 B2 * 10/2004 Kukita ..... H05K 7/1007 439/862
2014/0179167 A1 6/2014 Long et al. ..... 439/630
2017/0208687 A1 * 7/2017 Morimoto ..... H01R 12/52
2019/0372258 A1 * 12/2019 Lybrand ..... H01R 12/722

FOREIGN PATENT DOCUMENTS

DE 202013010545 * 2/2014 ..... H01R 12/58
EP 0 542 652 11/1992 ..... H01R 9/09
EP 0542652 A1 * 5/1993 ..... H01R 12/585

OTHER PUBLICATIONS

International Preliminary Report on Patentability issued in PCT/DE2019/100009, dated Jul. 28, 2020, 6 pages.
International Search Report and Written Opinion issued in PCT/DE2019/100009, with English translation, dated Apr. 8, 2019, 15 pages.

* cited by examiner

PRINTED-CIRCUIT BOARD CONNECTOR FOR HIGH-CURRENT TRANSMISSION

BACKGROUND OF THE INVENTION

The invention is based on a printed-circuit board connector.

Printed circuit board connectors of this type are required in order to electrically connect two printed circuit boards to one another which are arranged perpendicular to one another and thus also to make it possible to transmit high currents >10 amperes. In particular, this can be important when constructing electrical apparatuses if, for example, a first printed circuit board is guided perpendicular to a front surface of the housing, in order to be connected to this front surface via a heavy current plug connection.

BRIEF DESCRIPTION OF THE PRIOR ART

Printed circuit boards and printed-circuit board connectors are known from the prior art. In principle, using electrical connectors for high currents >10 amperes between two printed circuit boards is problematic due to the geometric conditions.

In the prior art, it is particularly disadvantageous that there is no existing cost-effective and reliable heavy current connection between two printed circuit boards which are arranged perpendicular to one another.

OBJECT OF THE INVENTION

The object of the invention involves specifying a printed-circuit board connector as a cost-effective and reliable heavy current connection between two printed circuit boards. In this case, high currents >10 amperes are regarded as heavy current.

SUMMARY OF THE INVENTION

For transmitting electrical power, a printed-circuit board connector is provided with high currents of more than 5 amperes, for example, preferably more than 10 amperes, in particular more than 15 amperes, i.e. of more than 20 amperes, for example. The printed-circuit board connector has at least one metallic, one-piece pin contact. In particular, one single pin contact of this type can transmit more than 5 amperes, preferably more than 10 amperes, in particular more than 15 amperes, i.e. of more than 20 amperes, for example. The pin contact possesses a connection region at a first end, with which connection region the pin contact can be soldered to a first contact region of a first printed circuit board and/or can be pressed into the first printed circuit board. Opposite, at a second end, the pin contact possesses a plug-in region with a slot, running in the direction of the first end, for mechanically fixing and for electrically contacting at least one second contact region which is arranged at the edge of a second printed circuit board.

This is particularly advantageous for automated production, since the second printed circuit board can be plugged into the slot of the at least one pin contact and can be soldered thereto.

For this purpose, the slot advantageously possesses a constant width which corresponds in particular to the thickness of the second printed circuit board.

In one preferred configuration, the pin contact can possess an axis of symmetry or a plane of symmetry, the slot running in the direction thereof. This serves to optimize the balance between material costs and stability.

The pin contact can be soldered to the first printed circuit board or can be pressed into said first printed circuit board in such a manner that the slot runs perpendicular to the first printed circuit board, so that the second printed circuit board, which is inserted into the slot, is therefore automatically oriented perpendicular to the first printed circuit board and at the same time can be electrically contacted therewith via the pin contact. This is particularly advantageous for constructing an electrical apparatus with a cuboid housing, since the printed circuit boards can in this way be guided parallel to the respective housing walls.

In one advantageous configuration, the at least one pin contact has a flange between its connection region and its plug-in region, which flange runs perpendicular to the slot, for strengthening its attachment and for orienting it on the first printed circuit board.

The connection region of the pin contact can be implemented as a solder connection. The pin contact is then a solder contact. The second printed circuit board, which is plugged into the slot, is then typically also additionally soldered to the plug-in region of the pin contact by way of its second contact region.

In a different configuration, the connection region of the pin contact can be implemented using press-in technology. The pin contact is then a press-in contact which possesses a corresponding through-opening in its plug-in region perpendicular to the plug-in direction. The second printed circuit board is then typically simply plugged into the slot of the pin contact by way of its second contact, in order to produce the desired electrical contact region with the first printed circuit board.

Combinations are of course also possible in which, for example, a press-in contact is additionally soldered to the first printed circuit board or in which a solder contact is also plugged into a contact bore of the first printed circuit board and is soldered thereto. Furthermore, a solder contact can also be combined with a second printed circuit board which is simply plugged into the slot (and not soldered thereto). The latter variant can serve to make it possible to be able to exchange the second printed circuit board for a different printed circuit board in a flexible manner, for example.

In particular, the pin contact can be a rotating part, in other words it is produced by a so-called "rotation". This has the advantage that the pin contact can be produced in a solid, stable and relatively cost-effective manner.

One arrangement has at least the following:

- the first printed circuit board, which possesses at least the first electrical contact region;
- the second printed circuit board, which possesses at least the second and a third electrical contact region which are connected to one another in an electrically conductive manner via a conductor track of the second printed circuit board;
- the printed-circuit board connector for electrically connecting the first contact region to the second contact region.

In this case, the second printed circuit board can be plugged into the slot of the pin contact and thus be soldered to the second contact region thereof. This has the advantage that the second printed circuit board can be fixed to the pin contact and thus can be contacted with only little effort, in particular in an automated manner. As a result, the second printed circuit board can be mechanically fixed to the first printed circuit board and at the same time possess at least one electrically conductive connection to the first printed circuit board.

Furthermore, the arrangement can possess an in particular cuboidal apparatus housing in which the two printed circuit boards are arranged. In this case, the first printed circuit board can be oriented perpendicular to a front side of the apparatus housing and the second printed circuit board can run parallel to the front side. This has the advantage that the installation space which is available in the apparatus is particularly well utilized.

The front side of the apparatus housing can possess a through-opening as well as a plug connector housing which is affixed thereto. This is advantageous in order to supply the printed circuit boards with electrical power.

A contact carrier with at least one plug contact located therein can be attached to the second printed circuit board for this purpose.

The plug contact can be fixed to the third contact region of the second printed circuit board in an electrically conductive manner on one side and project into the plug connector housing at the plug-in side. This has the advantage that electrical power can be inserted into the apparatus and can be internally transmitted from the second printed circuit board to the first printed circuit board.

Advantageously, the plug contact can project into the plug connector housing at the plug-in side. This serves to make plugging with an external mating plug possible. The external mating plug is typically a socket plug with socket contacts, since current-carrying parts in the region of the heavy current transmission cannot be freely accessible for reasons of safety. For this reason, the corresponding plug contacts which are connected to the second printed circuit board are preferably corresponding pin contacts.

In particular, the plug contact can be a heavy current contact which is suitable for transmitting currents of at least 10 amperes per contact. This has the advantage that the second printed circuit board and moreover also the first printed circuit board can be supplied with correspondingly high currents. In particular, although it runs perpendicular to the front surface in which the plug connector housing is arranged, the first printed circuit board can be supplied with these high currents.

In one preferred configuration, the second printed circuit board, in addition to said fixing by way of the at least one contact pin, can be additionally attached via a support element on the first printed circuit board and/or by means of a screw connection on the front side of the apparatus housing, in order to resist the plug forces of the plug contact and in particular to keep away the corresponding leverage forces from the pin contacts.

BRIEF DESCRIPTION OF THE DRAWINGS

An exemplary embodiment of the invention is depicted in the drawings and is explained in greater detail hereinafter. In the drawings.

The figures contain partially simplified, schematic depictions. Identical reference numbers are partly used for the same but not necessarily identical elements. Different views of the same elements could be scaled differently.

DETAILED DESCRIPTION OF THE INVENTION

Figure 1A:
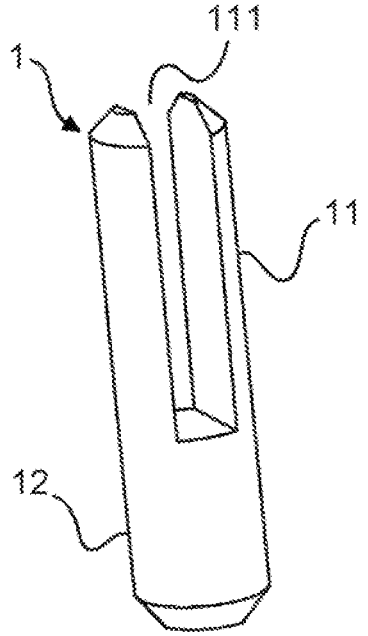
FIGS. 1*a-c* show the pin contact as a solder contact without and with a flange.

FIG. 1*a* shows a pin contact 1 which is implemented as a solder contact. This pin contact 1 possesses a cylindrical basic shape. The pin contact possesses a connection region 12 at a first end, which connection region can be soldered to a first contact region 211 of a first printed circuit board 21.

The pin contact 1 possesses a plug-in region 11 at a second end which is opposite the first end. The pin contact 1 possesses a slot 111 in the plug-in region 11. This slot 111 is suitable for receiving a second contact region 221 of a second printed circuit board 22 in a form-fitting and force-fitting manner, which is shown in FIGS. 2*a* and 2*b*.

Figure 1B:
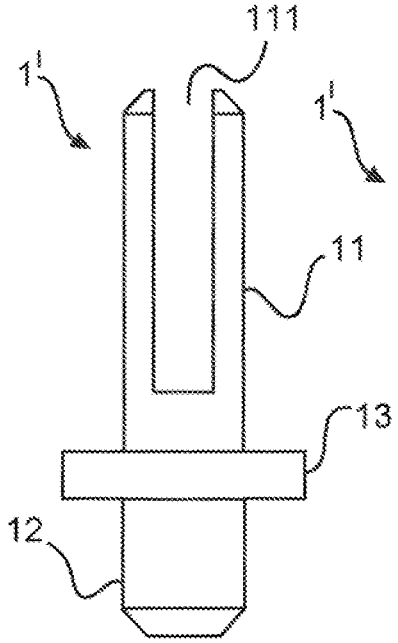
Figure 1C:
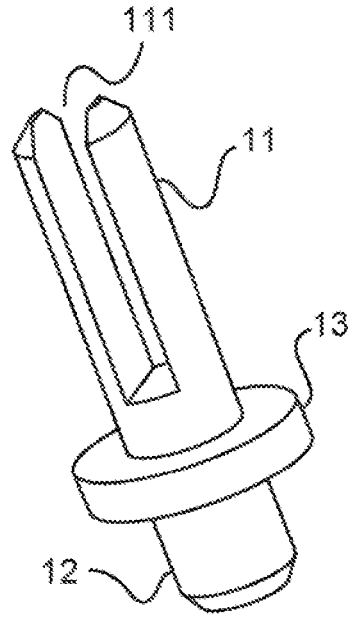

FIGS. 1*b* and 1*c* show a similar pin contact 1' which only differs from the previous pin contact 1 in that it additionally possesses a circumferential flange 13 which is arranged between its plug-in region 11 and its connection region 12. This flange 13 serves to additionally support and stabilize the soldered pin contact 1' on the first printed circuit board 21. In this case, the connection region 12 of the pin contact 1 is plugged through a contact bore 210 of the first contact region 211 of the first printed circuit board 21. This is not absolutely necessary for soldering, but it does ensure a higher degree of stability in the present case.

Figure 1D:
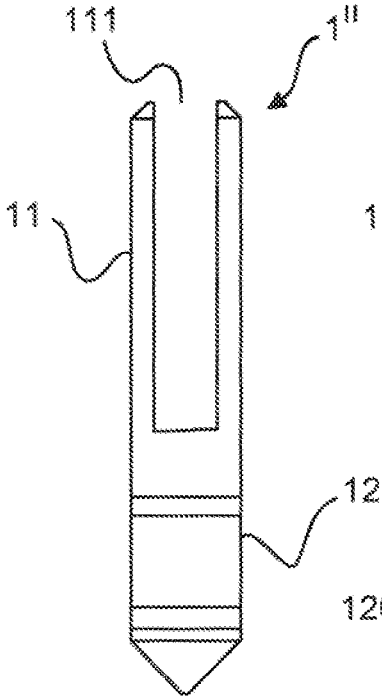
FIGS. 1*d-f* show the pin contact using press-in technology
Figure 1E:
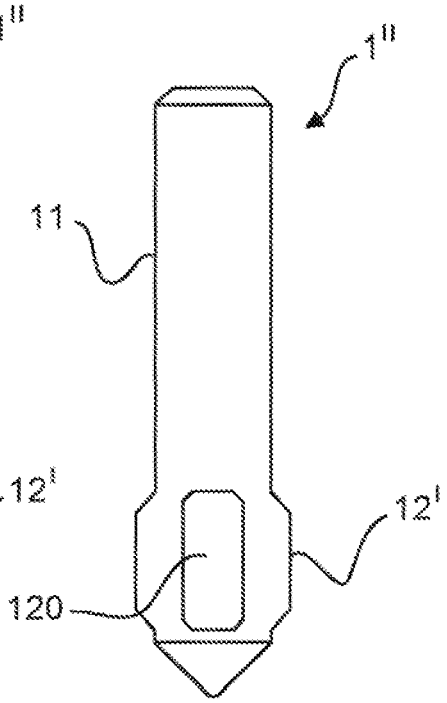
Figure 1F:
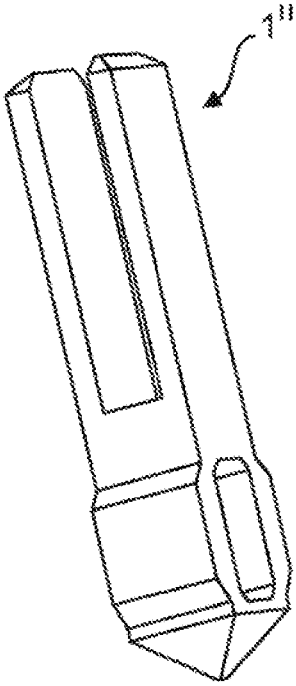

FIGS. 1*d-f* show a further pin contact 1" in a second embodiment, namely as a press-in contact. The basic shape of this further pin contact 1" is substantially cuboidal. Its connection region is tapered toward the first end and possesses a through-opening 120. It is thus implemented using press-in technology and can electrically contact the first printed circuit board 21 by way of the contact bore 210, without a soldering process being necessary for this purpose. The connection region 1 of the further pin contact 1" also possesses said slot 111 for receiving the second contact region 221 of the second printed circuit board 22 and differs from that of the aforementioned pin contacts 1,1' only by said cuboidal basic shape. The pin contacts shown are made in one piece and consist of metal.

Figure 2A:
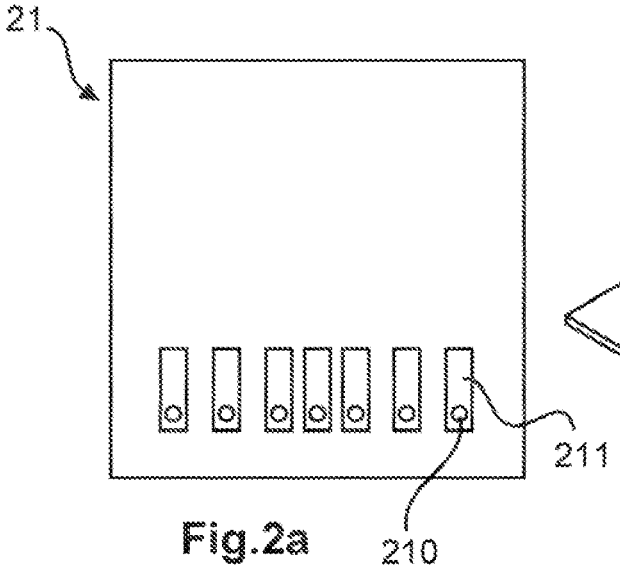
FIGS. 2*a-f* show a first arrangement of a first and a second printed circuit board and a printed-circuit board connector with solder connections.
Figure 2B:
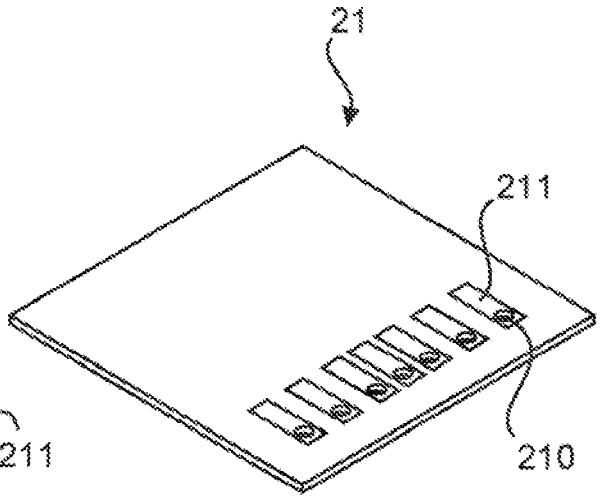

As already indicated, FIGS. 2*a* and 2*b* show a plan view and an oblique view of the first printed circuit board. In this case, no conductor tracks are shown, although these can of course exist. However, the first contact regions 211 as well as the associated contact bores 210 are clearly visible.

Figure 2C:
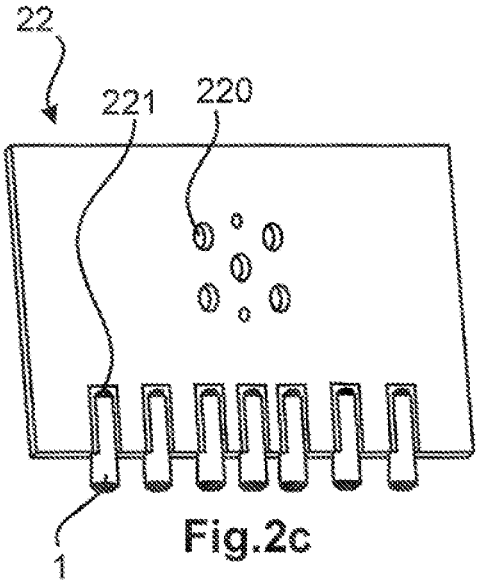

FIG. 2*c* shows a slightly oblique view of the second printed circuit board 22, wherein it is already inserted into the slot 111 of the plug-in regions 11 of the plug contacts 1 by way of its second contact regions 221. These contact regions can additionally optionally be soldered to the plug-in regions.

Figure 2D:
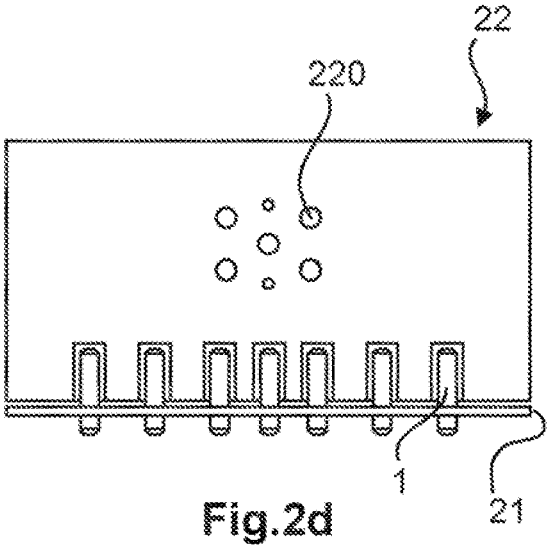
Figure 2E:
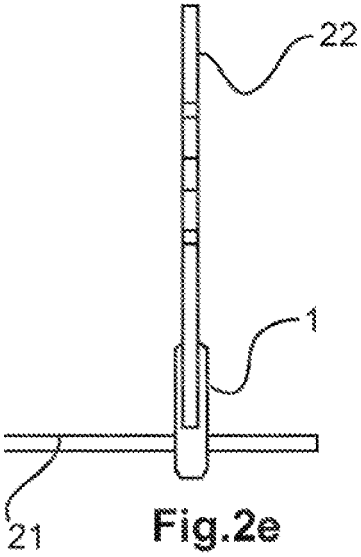
Figure 2F:
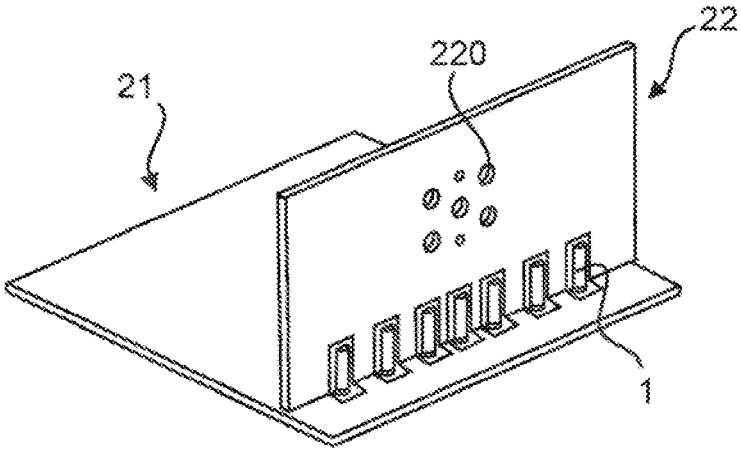

FIGS. 2*d-f* show an arrangement having the first printed circuit board 21, the second printed circuit board 22 and pin contacts 1 in the plugged-together and soldered state. It is readily apparent that the pin contacts 1 are guided through the contact bores 210 of the first printed circuit board 21 on the connection side. In addition, the connection regions 12 of the pin contacts 1 are soldered to the first contact regions

211 of the first printed circuit board 21. The second printed circuit board 22 is plugged into the slot 111 of the plug-in regions 11 of the pin contacts 1 by way of its second contact regions 221. Said second printed circuit board can therefore be exchanged for a different second, possibly slightly differently assembled, printed circuit board at any time, with little effort. However, this specific assembly is not essential for understanding the present invention and is therefore not shown.

Furthermore, it is easily recognizable that the two printed circuit boards 21, 22 are perpendicular to one another as a result of the pin contacts 1.

Moreover, the second printed circuit board 22 possesses plug contact bores 220 which are connected to at least some of the second contact regions 221 by way of third contact regions, which are not depicted in the drawing, via conductor tracks, which are not shown. These plug contact bores 220 serve to introduce and contact plug contacts which are not shown.

Figure 3A:
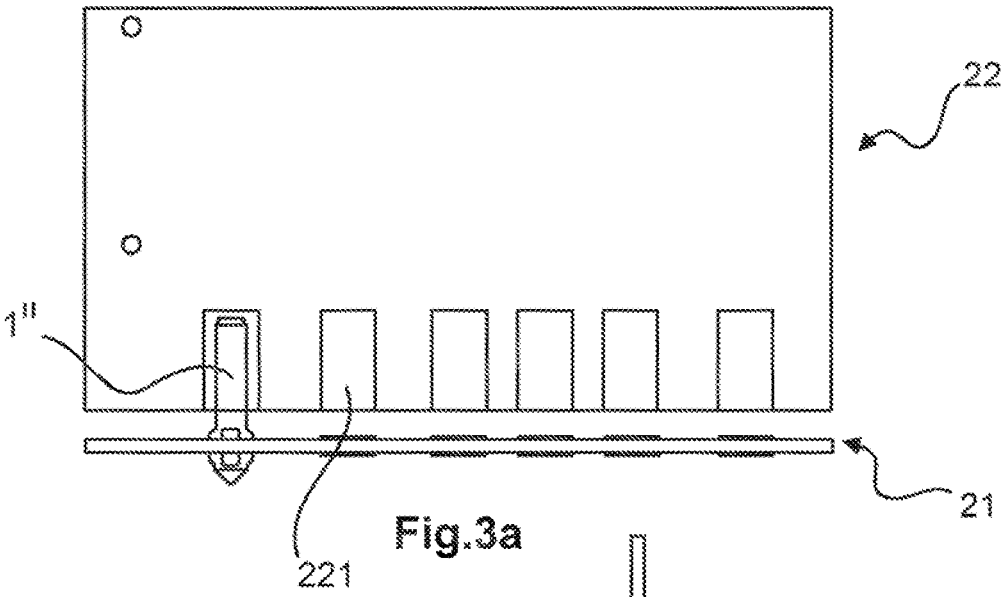
FIGS. 3*a-c* show a second arrangement of a first and a second printed circuit board and a printed-circuit board connector using press-in technology.
Figure 3B:
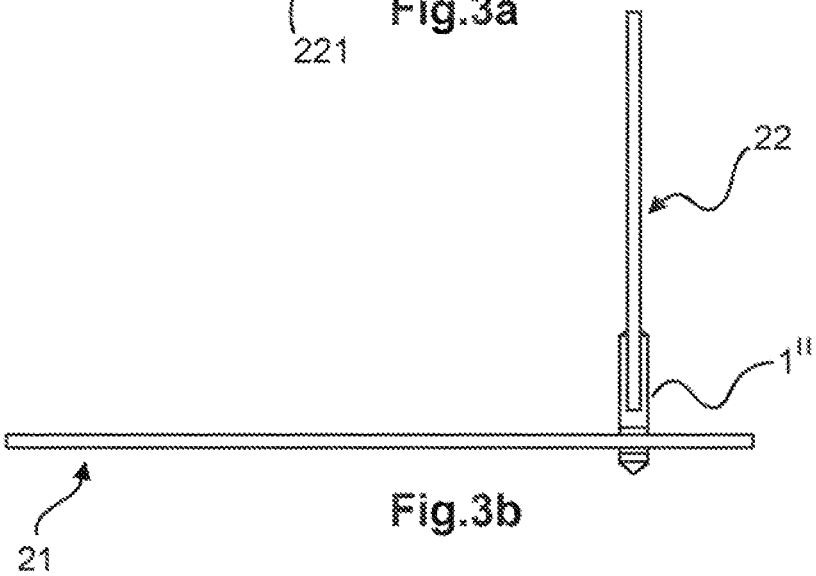
Figure 3C:
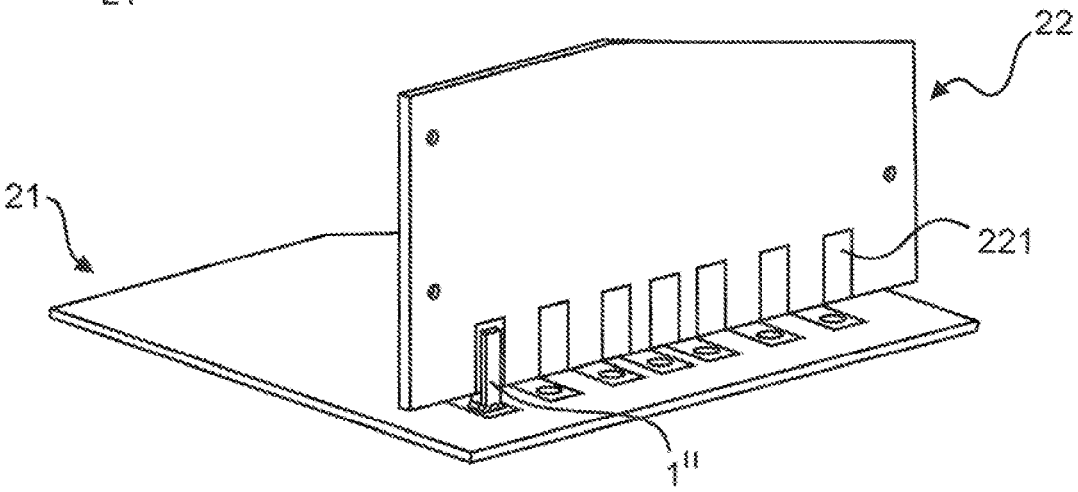

FIGS. 3*a*-3*c* show a similar arrangement with the pin contacts 1' which are implemented using press-in technology. In the present case, they are therefore not soldered to the first printed circuit board 21 but rather produce the electrical contact with the first contact regions by simply plugging their connection regions into the contact bores 210.

Figure 4A:
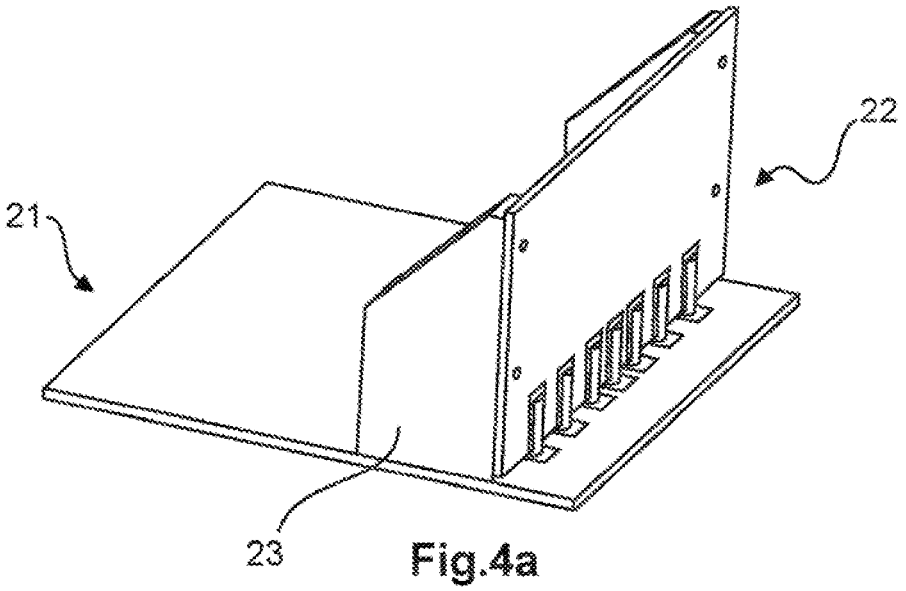
FIGS. 4*a, b* show the first arrangement with a support element.
Figure 4B:
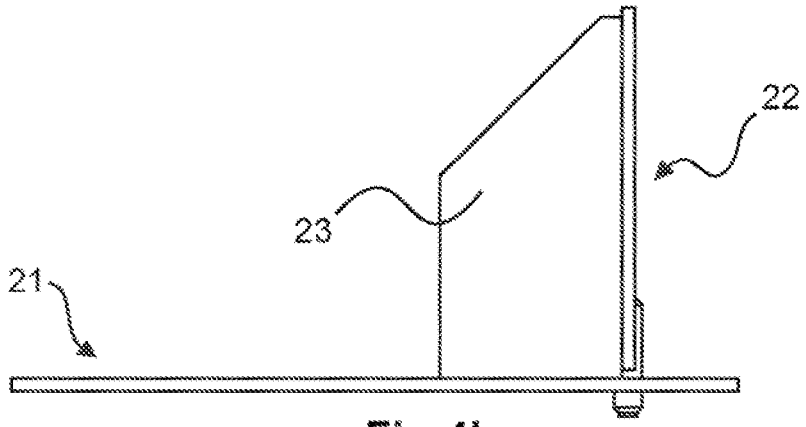
FIG. 4*c* shows the second printed circuit board with perforations for attaching to a front side of an apparatus housing.
Figure 4C:
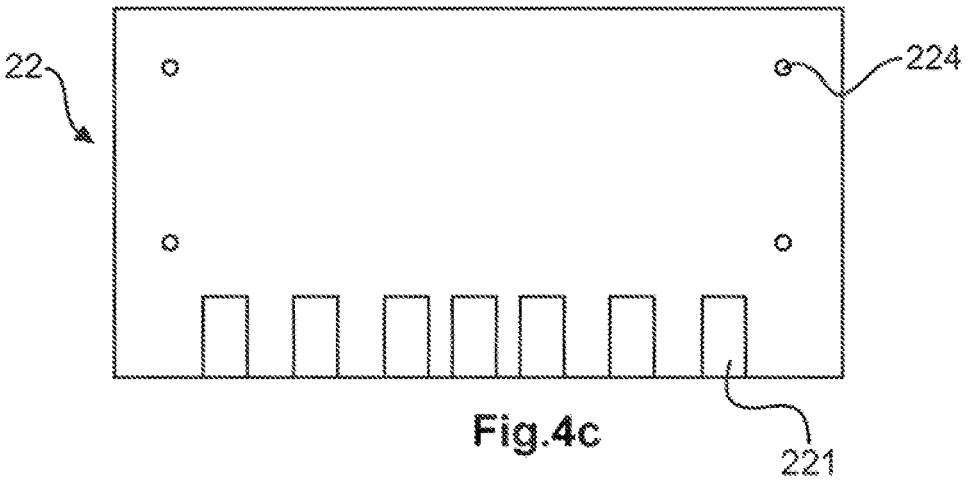

FIGS. 4*a*-4*c* show structures which serve to relieve the respective pin contact 1, 1', 1" of the mechanical plug forces which act on the second printed circuit board 22.

FIGS. 4*a* and 4*b* show two support elements which attach the second printed circuit board to the first printed circuit board on both sides.

Alternatively or additionally, the second printed circuit board 22 can also have attachment bores 224, as shown in FIG. 4*c*. Using these attachment bores 224, said second printed circuit board can be screwed to the front side of the apparatus housing, which is not shown, using screw bolts or long screws, for example, and can therefore be fixed thereto in a stable manner. As a result, the pin contacts 1, 1', 1" are relieved of plug forces which act on the second printed circuit board 22.

Even if different aspects or features of the invention are each shown in combination in the figures, it is clear to a person skilled in the art—unless otherwise specified—that the combinations depicted and discussed are not the only possible combinations. In particular, mutually corresponding units or feature complexes from different exemplary embodiments can be exchanged with one another.

LIST OF REFERENCE NUMBERS

1, 1', 1" Pin contact
11 Plug-in region
111 Slot
12, 12' Connection region
120 Through-opening
13 Flange
21 First printed circuit board
210 Contact bore
211 First contact region
22 Second printed circuit board
220 Plug contact bores
221 Second contact region
23 Support element

The invention claimed is:

1. An arrangement which has at least the following:
the first printed circuit board, which possesses at least the first electrical contact region;
the second printed circuit board, which possesses at least the second and a third electrical contact region which are connected to one another in an electrically conductive manner via a conductor track of the second printed circuit board; and
the printed-circuit board connector as claimed in one of the preceding claims for electrically connecting the first contact region to the second contact region,
wherein the second printed circuit board is plugged into the slot of the at least one pin contact by way of its at least one second contact region, in order to produce a mechanical fixing to an electrically conductive connection to the first printed circuit board, and
wherein the second printed circuit board is additionally also soldered to the connection region of the at least one pin contact by way of its at least one second contact region.

2. The arrangement as claimed in claim 1,
wherein the arrangement further possesses an apparatus housing in which the two printed circuit boards are arranged,
wherein the first printed circuit board is oriented perpendicular to the front side of the apparatus housing,
wherein the second printed circuit board runs parallel to the front side,
wherein the front side possesses a through-opening as well as a plug connector housing which is affixed thereto,
wherein a contact carrier with at least one plug contact located therein is attached to the second printed circuit board,
wherein the plug contact is fixed to the third contact region of the second printed circuit board in an electrically conductive manner on one side and projects into the plug connector housing at the plug-in side.

3. The arrangement as claimed in claim 2, wherein the second printed circuit board is additionally attached via a support element on the first printed circuit board and/or a screw connection on the front side of the apparatus housing, in order to resist the plug forces of the plug contact.

4. The arrangement as claimed in claim 2, wherein the second printed circuit board is additionally attached via a support element on the first printed circuit board and/or a screw connection on the front side of the apparatus housing, in order to resist the plug forces of the plug contact.

5. The arrangement as claimed in claim 1, wherein the plug contact is a heavy current contact Which is configured for transmitting currents of more than 10 amperes.

* * * * *